US005349335A

United States Patent [19]

Lin

[11] Patent Number: 5,349,335

[45] Date of Patent: Sep. 20, 1994

[54] AUTOMATIC GAS SPRAY DEVICE

[76] Inventor: Der-Song Lin, 2F, No. 9-1, Alley 18, Lane 410, Jingshin Street, Chung-Ho City, Taipei, Taiwan

[21] Appl. No.: 51,342

[22] Filed: Apr. 23, 1993

[51] Int. Cl.[5] ..... G08B 21/00

[52] U.S. Cl. ..... 340/636; 340/574; 340/691; 222/3

[58] Field of Search ..... 340/632, 628, 636, 691, 340/574; 222/3, 23, 39, 41; 169/60, 61, 54, 51

[56] References Cited

U.S. PATENT DOCUMENTS 5,016,715 5/1991 Alasio ..... 169/54 X
5,126,078 6/1992 Steiner et al. ..... 340/636
5,153,567 10/1992 Chimento ..... 169/51 X

*Primary Examiner*—Jeffery A. Hofsass

*Attorney, Agent, or Firm*—Morton J. Rosenberg; David I. Klein

[57] ABSTRACT

An automatic gas spray device for deterring crime is provided. The device includes a longitudinally grooved seat and a spring inside a casing for securing the position of a gas tank. A female connector on the outlet of the gas tank is detachably connected to a male connector coupled to a nozzle through a solenoid valve. A battery case is fastened to an opening formed in the casing, into which a rechargeable battery is inserted and covered by a battery lid. A control main unit disposed within the casing is controlled by a sensor to give a warning sound for 5 seconds and then to switch on the solenoid valve for dispensing gas from the nozzle for a predetermined time duration. A gas volume monitor and a battery power indicator is also provided.

1 Claim, 2 Drawing Sheets

AUTOMATIC GAS SPRAY DEVICE

BACKGROUND OF THE INVENTION

The present invention relates to a type of automatic gas spray device, particularly to one that automatically spray irritative gas in case of an attack, to hinder criminals.

U.S. Pat. No. 5,034,730, issued to the present inventor, discloses an automatic gas spray device for protection against criminals which can be installed at various locations to automatically spray irritative gas activated by an electronic control main unit and a solenoid sensor for hindering criminals in case of an attack. This automatic gas spray device is effective in use, however, it still has some drawbacks. One drawback of this device is that the electronic control main unit and the solenoid sensor are difficult to install. Another drawback is that the housing must be dismantled when replacement of the gas tank is needed. Further, this structure of automatic gas spray device has no indicator means to indicate the current electric quantity of the battery power supply and the current amount of gas in the gas tank.

SUMMARY OF THE INVENTION

The present invention eliminates the aforesaid drawbacks. According to one aspect of the present invention, the casing of the automatic gas spray device has a longitudinally grooved seat at the bottom, a spring at the back, and a male connector connected to a nozzle through a solenoid switch at the front, so that the Gas tank can be quickly installed in position with the female connector on its gas outlet connected to the male connector. According to another aspect of the present invention, a gas volume monitor and a battery power indicator are mounted on the casing to indicate the current volume of gas in the gas tank and the current electric quantity of the battery power supply.

DETAILED DESCRIPTION OF THE PREFERRED EMBODIMENT

Figure 1:
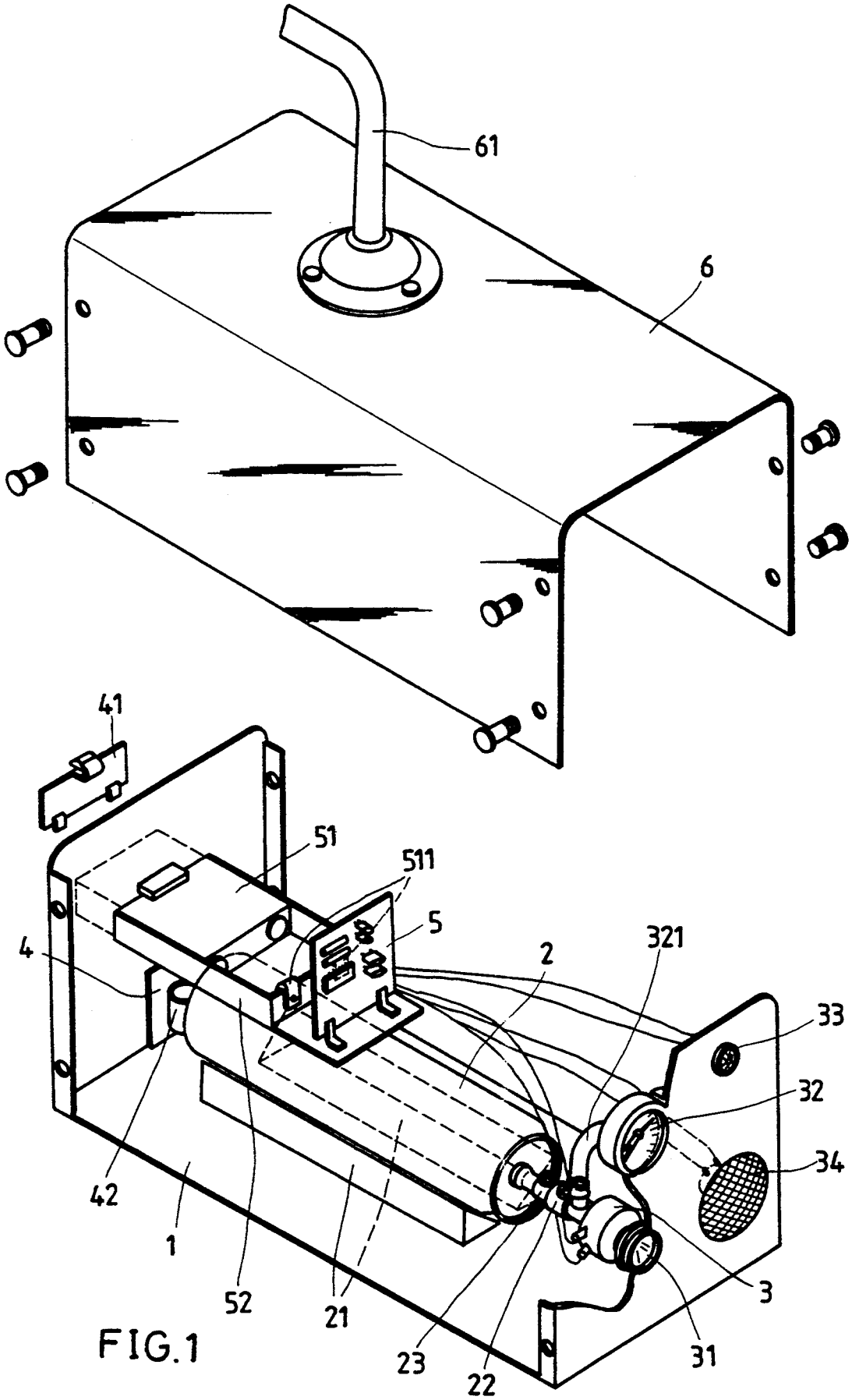
FIG. 1 is a perspective exploded view of an automatic gas spray device of the present invention.
Figure 2:
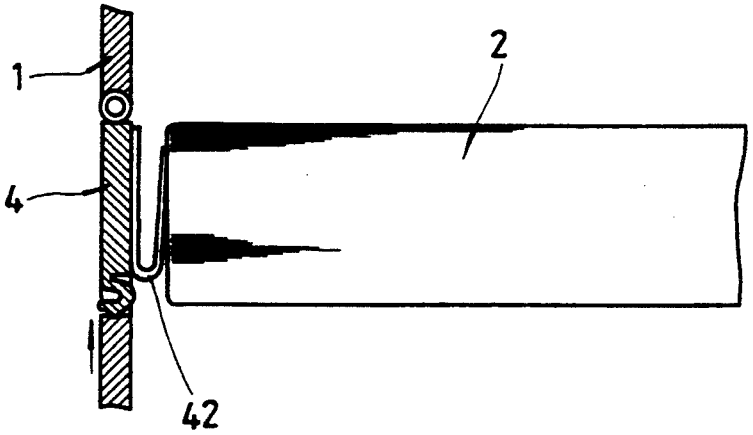
FIG. 2 is a partial sectional view of the gas tank back support of the automatic gas spray device shown in FIG. 1.
Figure 3:
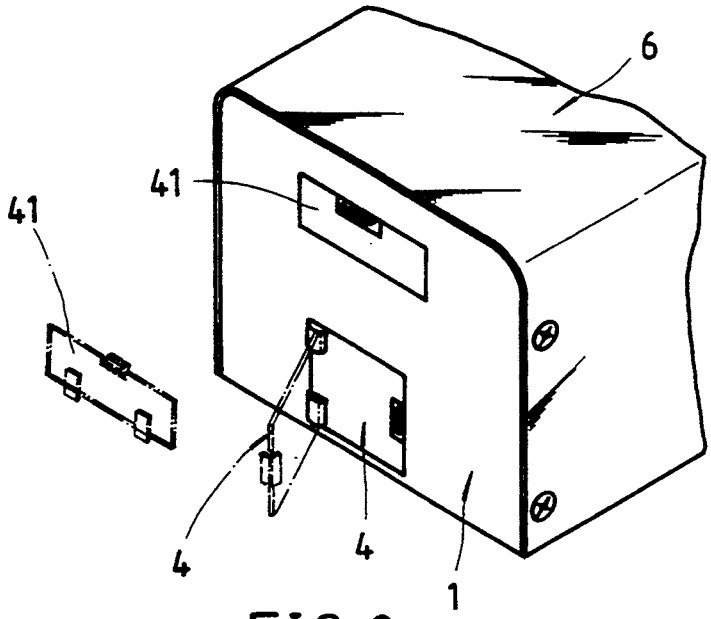
FIG. 3 illustrates the relative positions of the gas tank back support and the battery lid on the casing.
Figure 4:
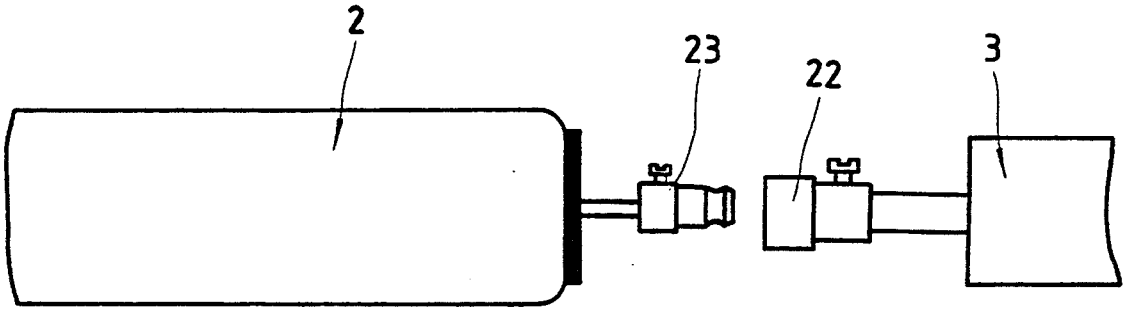
FIG. 4 illustrates the gas tank detached from the solenoid switch.

Referring to FIGS. 1, 2 and 3, a gas tank seat 21 having a longitudinally V-shaped groove is fastened inside a casing 1 to hold a gas tank 2. A spring 42 is fastened to a back cover 4 hinged to the casing 1 at the back. A solenoid valve 3 is fastened to the casing 1 at the front. A nozzle 31 is connected to the solenoid valve 3 at the front outside the casing 1. A male connector 22 is connected to the solenoid valve 3 at the back inside the casing 1. The gas tank 2 has its outlet coupled with a female connector 23. After the gas tank 2 has been positioned in the gas tank seat 21, the female connector 23 is connected to the male connector 22, with the closed end of the tank 2 stopped against the spring 42 to maintain a bias force on the connection of connectors 22 and 23. A gas monitor, such as a pressure gauge 32 is connected to the connection between the solenoid valve

3 and the male connector 22 by a guide tube 321 for monitoring the amount of gas in the gas tank 2. A battery case 52 with positive and negative contacts 511 is fastened inside the casing 1 behind an access hole (not shown) formed therethrough and covered with a battery lid 41 to hold a rechargeable battery 51. By opening the battery lid 41, the rechargeable battery 51 can be slid in and out of the battery case 52. An electronic control main unit 5 is fastened to the battery case 52 inside the casing 1, and controls the production of sound through a speaker 34 for a predetermined time duration and then switches on the solenoid valve 3 to release a flow of irritative gas from the nozzle 31, followed by switching off the solenoid switch to stop the passage of gas to the nozzle 31 after a predetermined time duration. A low voltage indicating lamp 33 is mounted on the outside of casing 1 and is connected to the electronic control main unit 5 to illuminate the lamp when the voltage of the rechargeable battery 51 drops below a predetermined range. When assembled, the casing 1 is covered by a top cover 6 and installed to a wall by a mount 61.

What is claimed is:

1. An automatic gas spray device for discharge of an irritative gas to deter crime, comprising:

an enclosed housing having a pair of opposing longitudinally displaced end walls, a first of said end walls having a pair of through openings formed therethrough to provide access to a cavity interior to said enclosed housing;

a gas tank seat member having a longitudinally V-shaped groove is disposed within said cavity in longitudinal alignment with a first of said pair of through openings formed in said first end wall, said first through opening having a predetermined open area dimension;

a gas storage tank having a cross-sectional area dimension less than said predetermined open area dimension for insertion of said gas storage tank through said first through opening, said gas storage tank having a closed end and an outlet pipe coupled to an opposing end thereof, said outlet pipe being in fluid communication with a pressurized irritative gas contained within said gas storage tank;

a female fluid coupling secured to a distal end of said outlet pipe;

a nozzle extending through an opening formed through a second of said housing end walls;

a solenoid valve having a outlet in fluid communication with said nozzle, said solenoid valve having an electrical input for opening a fluid path therethrough responsive to an electrical control signal;

a male fluid coupling secured to an inlet of said solenoid valve and disposed in alignment with said female coupling for detachable connection therewith;

a pressure gage having an inlet in fluid communication with said solenoid valve inlet and an indicator viewable through an opening formed said second housing end wall;

cover means coupled to said first through opening for forming a closure therefore, said cover means including (1) a first closure member having a front and a rear surface and being releasably securable to said first through opening, and (2) a spring member having one end affixed to said rear surface of said first closure member and an opposing end in contact with said closed end of said gas storage tank for providing a retention bias force thereto, said retention bias force being removed from said storage tank by displacement of said first closure member from said first through opening;

alarm means disposed adjacent an opening formed through said housing and having a signal input connection for generating an audio alarm responsive to an audio signal coupled to said input connection:

electronic control means disposed within said enclosed housing, said electronic control means including circuit means for generating (1) said audio signal for a predetermined time period, and (2) said electrical control signal subsequent to said predetermined time period responsive to a sensor signal input to said electronic control means, said electronic control means further including (1) a battery releasably coupled to said circuit means, (2) a battery case disposed within said enclosed housing and aligned with a second of said through openings formed in said first housing end wall for passage of said battery therethrough, and a lamp disposed in an opening formed through said second housing end wall and coupled to said electronic control means for indicating a battery voltage level below a predetermined voltage value; and, a second closure member releasably secured to said second through opening, whereby both said gas storage tank and said battery are replaceable through said respective first and second through openings formed in said first housing end wall of said enclosed housing.

* * * * *